US008284054B2

(12) United States Patent
Zang et al.

(10) Patent No.: US 8,284,054 B2
(45) Date of Patent: Oct. 9, 2012

(54) METHOD AND DEVICE FOR INTEGRATED NETWORK INTELLIGENT SECURITY MONITORING AND ALARMING

(75) Inventors: Shihua Zang, Nanjing (CN); Zhendong Wang, Nanjing (CN); Jiangsu Yu, Nanjing (CN); Weiguang Xiao, Nanjing (CN)

(73) Assignee: Swit Electronics Co., Ltd., Nanjing (CN)

( * ) Notice: Subject to any disclaimer, the term of this patent is extended or adjusted under 35 U.S.C. 154(b) by 621 days.

(21) Appl. No.: 12/533,964

(22) Filed: Jul. 31, 2009

(65) Prior Publication Data

US 2010/0039253 A1 Feb. 18, 2010

(30) Foreign Application Priority Data

Aug. 15, 2008 (CN) ..... 2008 1 0022553

(51) Int. Cl.
*G08B 13/00* (2006.01)

(52) U.S. Cl. ..... 340/541; 340/506; 348/143; 348/153

(58) Field of Classification Search ..... 340/506, 340/541, 545.3, 550; 348/142, 143, 152, 348/153, 159; 713/340; 382/192
See application file for complete search history.

(56) References Cited

U.S. PATENT DOCUMENTS

| | | | | |
|---|---|---|---|---|
| 7,079,028 | B2 * | 7/2006 | Herrmann et al. | 340/541 |
| 7,629,880 | B2 * | 12/2009 | Stilp et al. | 340/508 |
| 2005/0156737 | A1 * | 7/2005 | Al-Khateeb | 340/541 |
| 2007/0019077 | A1 * | 1/2007 | Park | 348/211.99 |
| 2007/0126871 | A1 * | 6/2007 | Henninger et al. | 348/151 |
| 2011/0274421 | A1 * | 11/2011 | Wang | 396/427 |

* cited by examiner

*Primary Examiner* — Brent Swarthout
(74) *Attorney, Agent, or Firm* — Global IP Services; Tian Hua Gu

(57) ABSTRACT

A method and a device for integrated network intelligent security monitoring and alarming are provided. The device includes a front cover (6) and a rear cover (10). A light-emitting diode (LED) infrared lighting circuit board (3) is installed on the front cover (6). An embedded microprocessor main control module board (16) and a wired and wireless broadband network module board (19), an image sensor module board (31), a wireless remote controller/alarm sensor signal receiving module board (22), a general packet radio service (GPRS) mobile phone short message and multimedia message transceiver module board (27), a siren control circuit board (21), and a piezoelectric speaker (20) electrically connected to the embedded microprocessor main control module board (16) are installed in an installing cavity between the front cover (6) and the rear cover (10). The method is simple, and the device has advantages of high integration, a small volume, multiple functions, and convenient installation and use.

7 Claims, 2 Drawing Sheets

METHOD AND DEVICE FOR INTEGRATED NETWORK INTELLIGENT SECURITY MONITORING AND ALARMING

CROSS REFERENCE TO THE RELATED PATENT APPLICATION

The present application claims the priority of the Chinese patent application No. 200810022553.1 filed on Aug. 15, 2008, which application is enclosed herein by reference.

BACKGROUND OF THE INVENTION

1. Field of Invention

The present invention relates to a security method and device, more particularly to a method and device for security monitoring and alarming that is able to detect a moving object inside an image monitoring area and related security devices automatically and transmit alarm information automatically, and specifically to a method and device for integrated network intelligent security monitoring and alarming.

2. Related Art

Currently, video monitoring on the Internet through a network camera or a network video server becomes a new development trend in the security industry. However, as a security monitor system, only a video monitoring function is usually insufficient. Some detection sensors or alarms for security usually need to be configured, such as a smoke detection sensor, a gas leakage alarm, a magnetic door alarm, a glass-broken alarm, a water immersion alarm sensor, an infrared human body detection sensor, a vibration alarm sensor, and a temperature alarm sensor. Even a common network camera or network video server has a wired input/output control interface, it is still difficult to connect the network camera or network video server to various sensors or alarms. The reason is that supply voltages of the various wired sensors are different. A special level-signal converter and an electric driving control circuit have to be interfaced outside the network camera or network video server to realize uniform control. Thus, not only extra cost is produced, but also installing positions for a control box or a chassis need to be added in a room. As alarm sensors are to be placed at different positions or on different objects depending on their respective functions, such as in the office, storeroom, kitchen, or toilet, or on the door, window, ceiling, safe, or counter, in order to connect them to the network camera or network video server, many cables and wires need to be laid in the room, even holes need to be drilled in walls, wire tubes need to be inserted, and wire grooves need to be hammered. The construction is difficult and the expense is high, and the beauty and style of the original decoration in the room might be spoiled. In addition, the network camera or the network video server usually transfers images and alarm information on a wired broadband network, and the images and alarm information cannot be transferred to a mobile phone directly. Many people have demands for security monitoring but without the broadband network environment thus cannot use such products.

SUMMARY OF THE INVENTION

The present invention is directed to a method and device for integrated network intelligent security monitoring and alarming, so as to solve the problems of inconvenience in installation and use, as well as the problem that images and alarm information are unable to be transferred to a mobile phone directly as an existing network camera or network video server additionally needs a control box or a chassis, and needs a lot of wires and cables to be connected to various security sensors or alarms.

The present invention provides the following technical solutions.

A method for integrated network intelligent security monitoring and alarming is provided, which includes the following steps.

An image in a whole area taken by a camera head is input to an embedded microprocessor control device. A computer is connected to the embedded microprocessor control device through a network. An alarm area in the image to be monitored is selected with a frame by using a mouse. The alarm area is then preset in the embedded microprocessor control device.

If a moving object appears in the alarm area in the monitored image, the embedded microprocessor control device video records, photographs, and records the moving object in a memory automatically under the control of software, sends a video or a photograph to a preset mailbox through an email or to a preset mobile phone through a multimedia message, and transmits an audio/light alarm signal at the same time.

An identity code signal transmitted by a wireless sensor (such as an infrared wireless sensor, a smoke detection alarm, a fire alarm, a sound control burglar alarm, a light control burglar alarm, a magnetic control burglar alarm, a carbon monoxide content sensor, a gas leakage monitoring sensor) is memorized in a control device integrated with the camera head in advance through study. When any wireless sensor transmits an alarm signal, a wireless receiving circuit in the control device receives the alarm signal and makes determination instantly, and then reports an email, a short message or a voice message to a preset mailbox, mobile phone or alarm center.

In order to realize the method, the present invention further provides an integrated alarm device.

A device for integrated network intelligent security monitoring and alarming is provided, which includes a front cover 6 and a rear cover 10. A light-emitting diode (LED) infrared lighting circuit board 3 is installed on the front cover 6. An embedded microprocessor main control module board 16 and a wired and wireless broadband network module board 19, an image sensor module board 31, a wireless remote controller/alarm sensor signal receiving module board 22, a general packet radio service (GPRS) mobile phone short message and multimedia message transceiver module board 27, a siren control circuit board 21, and a piezoelectric speaker 20 electrically connected to the embedded microprocessor main control module board 16 are installed in an installing cavity between the front cover 6 and the rear cover 10. The wired and wireless broadband network module board 19 is connected to a hidden 2.4 GHz or GPRS transceiver antenna 29 through a feeder 42. The image sensor module board 31 is installed on an upper part of the wired and wireless broadband network module board 19. Connection sockets 43 and 44 electrically connected to the image sensor module board 31 are disposed on the embedded microprocessor main control module board 16. A lens mount 30 of a fixed optical lens 13 is installed on the image sensor module board 31. The optical lens 13 is connected to a manual focus ring 1 through the embedded microprocessor main control module board 16, the front cover 6, and the LED infrared lighting circuit board 3 and an infrared light shield 2 installed on the front cover 6. Infrared light-emitting diodes 5 and a luminance sensor 4 are installed on the LED infrared lighting circuit board 3. The infrared light shield 2 covers the LED infrared lighting circuit board 3 from front. The piezoelectric speaker 20 is installed in the rear cover 10 and is connected to the siren control circuit board 21 through wires 33. The siren control circuit board 21 is connected to the wireless remote controller/alarm sensor signal receiving module board 22 through an antenna feeder 24. The wireless remote controller/alarm sensor signal receiving module board 22 and the embedded microprocessor main control module board 16 are electrically connected through plugging. One end of a telescopic wireless transceiver antenna 12 is fixed on the siren control circuit board 21 and is electrically connected thereto, and the other end of the telescopic wireless transceiver antenna 12 extends outside the rear cover 10.

A miniature microphone 32 and a memory card socket 15, an LED power indicator 40, and a status indicator 41 electrically connected to a main circuit of the embedded microprocessor main control module board 16 are installed on a front side of the embedded microprocessor main control module board 16. A semiconductor memory card 14 is plugged in the memory card socket 15. A sound receiving hole 9 is disposed on the front cover 6 at a position corresponding to the miniature microphone 32.

A sound resonant cavity 23 is disposed at the inner side of the rear cover 10. The sound resonant cavity 23 is connected to outside through a sound hole 39 disposed on the rear cover 10. The piezoelectric speaker 20 is inserted in the sound resonant cavity 23.

A subscriber identity module (SIM) card 28 is installed on the GPRS mobile phone short message and multimedia message transceiver module board 27. The GPRS mobile phone short message and multimedia message transceiver module board 27 and an input/output signal connection port 11 are electrically connected through plugging. The input/output signal connection port 11 is installed on the embedded microprocessor main control module board 16 and is connected to the main circuit thereof.

A DC power socket 17, a network connection socket 18, a Study button 25 for remote controller and alarm study, and a Reset button 26 for system reset are further connected to the wired and wireless broadband network module board 19. Corresponding through holes 34, 36, 37, and 38 are disposed at corresponding positions on the rear cover 10.

A fixed connecting hole 35 is disposed at a lower part of the rear cover 10 and/or the front cover 6.

The LED infrared lighting circuit board 3 and the infrared light shield 2 are connected through plugging. Locking holes 8 matching claws 7 on the infrared light shield 2 are disposed on the LED infrared lighting circuit board 3.

Beneficial effects of the present invention are as follows.

In the present invention, an existing video camera is combined with various wireless sensors and wired and wireless communication networks. Through coordination by software, respective functions are fully employed. Thus, problems of inconvenient installation and use as well as problems that images and alarm information cannot be transferred to a mobile phone directly as an existing network camera or network video server needs an additional control box or chassis and needs a lot of wires and cables to be connected to various security sensors or alarms are solved. Also, the installation is substantially simplified, and the monitoring concealment and alarm promptness is improved, producing advantages of high integrity, a small volume, multiple functions, and convenient installation and use.

Therefore, the alarm device of the present invention is also convenient to manufacture and has a fine appearance, a low cost, an infinitely expandable study function, and various expansion interfaces to match various new sensors so as to realize timely update.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

The present invention is illustrated in further detail below with reference to the accompanying drawings and embodiments.

Embodiment One

A method for integrated network intelligent security monitoring and alarming is provided, which includes the following steps.

An image in a whole area taken by a camera head is input to an embedded microprocessor control device. A computer is connected to the embedded microprocessor control device through a network. An alarm area to be monitored in the image is selected with a frame by using a mouse. The alarm area is then preset in the embedded microprocessor control device. The embedded microprocessor control device analyzes images collected within the area under control of software. When pixels in adjacent two or more images change (images analyzed per second are 1 to 10 frames), it may be determined that a moving object exists.

If a moving object appears in the alarm area in the monitored image, the embedded microprocessor control device video records, photographs, and records the moving object in a memory automatically under control of software, sends a video or a photograph to a preset mailbox through an email or to a preset mobile phone through a multimedia message, and transmits an audio/light alarm signal at the same time.

An identity code signal transmitted by a wireless sensor (such as an infrared wireless sensor, a smoke detection alarm, a fire alarm, a sound control burglar alarm, a light control burglar alarm, a magnetic control burglar alarm, a carbon monoxide sensor, a gas leakage monitoring sensor) is memorized in a control device integrated with the camera head in advance through study. When any wireless sensor transmits an alarm signal, a wireless receiving circuit in the control device receives the alarm signal and makes determination, and then reports an email, a short message or a voice message to a preset mailbox, mobile phone or alarm center.

The monitoring method of the present invention can be implemented through software plus hardware. Except for some simple self-made parts, most hardware may be miniature components commercially available.

Embodiment Two

Figure 1:
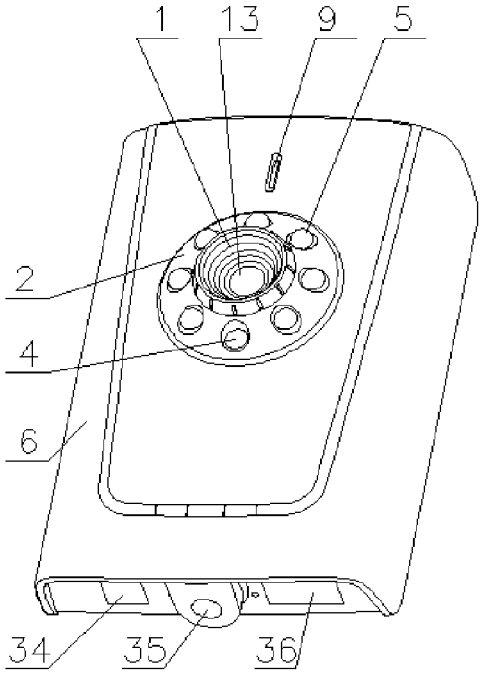
FIG. 1 is a three-dimensional schematic structural view of a front cover of an alarm device according to the present invention.
Figure 2:
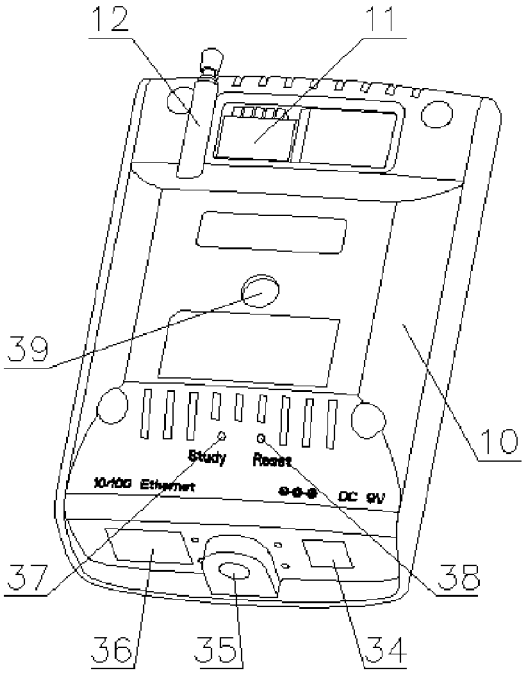
FIG. 2 is a three-dimensional schematic structural view of a rear cover of an alarm device according to the present invention.
Figure 3:
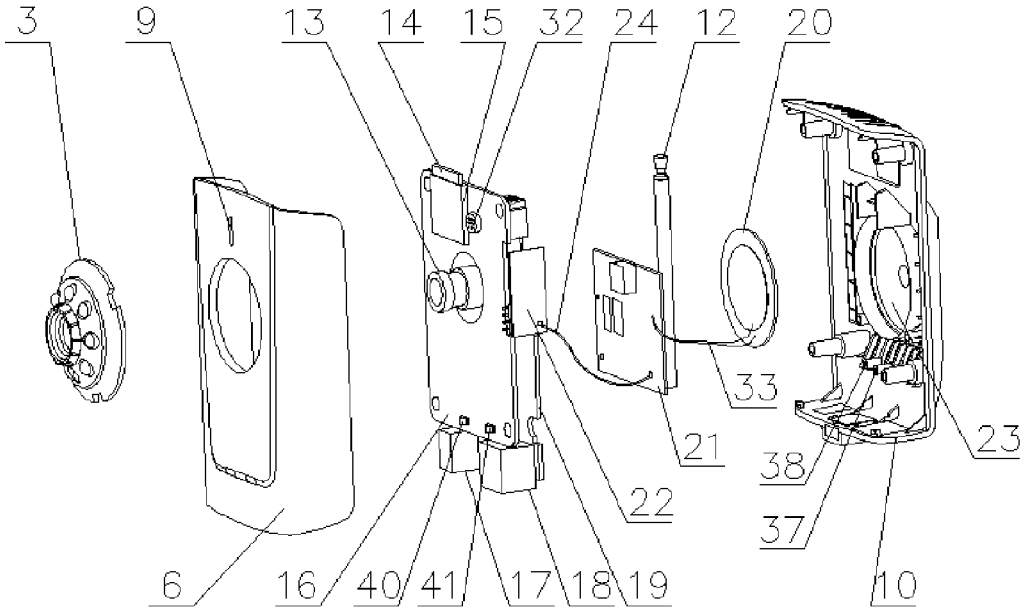
FIG. 3 is a schematic three-dimensional exploded structural view of an alarm device according to the present invention.
Figure 4:
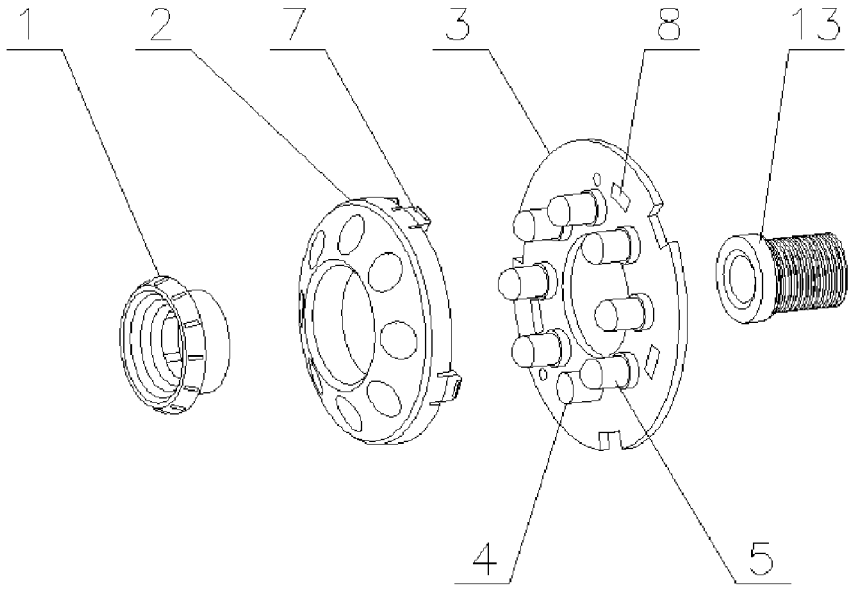
FIG. 4 is a schematic structural view of infrared lighting and optical lens parts in an alarm device according to the present invention.
Figure 5:
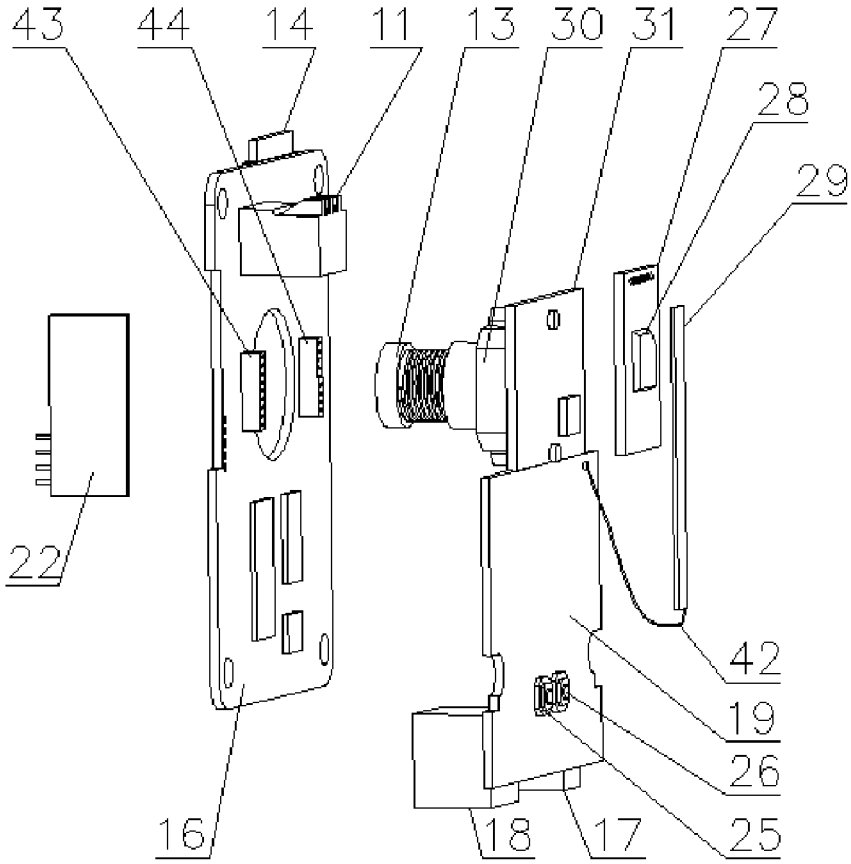
FIG. 5 is a schematic exploded structural view of an electric module part according to the present invention.

Referring to FIGS. 1 to 5, a device for integrated network intelligent security monitoring and alarming is provided. As shown in FIG. 3, the device mainly includes an embedded microprocessor main control module board 16, a wired and wireless broadband network module board 19, an image sensor module board 31, a wireless remote controller/alarm sensor signal receiving module board 22, a GPRS mobile phone short message and multimedia message transceiver module board 27, a hidden 2.4 GHz or GPRS transceiver antenna 29, an optical lens 13, a lens mount 30, a telescopic wireless transceiver antenna 12, an LED infrared lighting circuit board 3, a siren control circuit board 21, a piezoelectric speaker 20, a miniature microphone 32, a front cover 6 (see FIG. 1), and a rear cover 10 (see FIG. 2). A plurality of infrared light-emitting diodes 5 and a luminance sensor 4 is disposed on the LED infrared lighting circuit board 3. The infrared light shield 2 is locked by inserting three elastic claws 7 in three rectangular holes 8 of the infrared lighting circuit board 3. As shown in FIG. 4, a manual focus ring 1 is provided on the optical lens 13 through a central hole of the infrared light shield 2 and the infrared lighting circuit board 3. The optical lens 13 may be assembled on the lens mount 30. The lens mount 30 is installed on the image sensor module board 31 (as shown in FIG. 5). The image sensor module board 31 is connected to connection sockets 43 and 44 on the embedded microprocessor main control module board 16. The piezoelectric speaker 20 is inserted in a sound resonant cavity 23 inside the rear cover 10, and is connected to the siren control circuit board 21 through wires 33. The telescopic wireless transceiver antenna 12 is fixed on the rear cover 10 by the siren control circuit board 21, and is connected to the wireless remote controller/alarm sensor signal receiving module board 22 (a wireless receiving module with a tunable receiving frequency is disposed thereon, and is adapted to match a frequency of a remote control wireless transmitter of different frequencies through study) through an antenna feeder 24. Electrical pins of the wireless remote controller/alarm sensor signal receiving module board 22 are soldered on the embedded microprocessor main control module board 16. The miniature microphone 32 is soldered on a front side of the embedded microprocessor main control module board 16, a sound receiving end of which is corresponding to a sound receiving hole 9 on the front cover 6. The hidden 2.4 GHz or GPRS transceiver antenna 29 is connected to the wired and wireless broadband network module board 19 through a feeder 42. The GPRS mobile phone short message and multimedia message transceiver module board 27 may be electrically connected to the input/output signal connection port 11.

Tube-shaped guide holes 37 and 38 on the rear cover 10 directly oppose a Study button 25 for remote controller and alarm study, and a Reset button 26 for system reset. Thus, an operator may reliably press the buttons with a metal needle easily, and short circuit and scuffing that might occur when the metal needle is inserted and deflected on the circuit board is avoided.

In practical implementation, whether to install the GPRS mobile phone short message and multimedia message transceiver module 27 is determined depending on the demands, and its structure may also be otherwise designed according to actual demands in use. FIG. 5 only shows one structural form. As shown in FIG. 5, the GPRS mobile phone short message and multimedia message transceiver module board 27 is directly attached with a SIM card 28. In practical implementation, they may be disposed separately. Additionally, a small cap that is easy to open and close may be further designed on the rear cover 10. The small cap is opened to install or replace the SIM card conveniently.

In practical implementation, the image sensor module 31 should be selected and designed according to whether the camera head is a complementary metal oxide semiconductor (CMOS) apparatus or a charge coupled device (CCD) apparatus. The image projected on the image sensor may be adjusted to a most clear status by suitably rotating the manual focus ring 1 sleeved on the optical lens 13.

The process of the wireless remote controller and alarm study in the present invention is as follows.

In order to avoid same-band interferences or false alarm, a unique identity code and operation code is sent in both the wireless remote controller and security alarm sensor. When the present invention works normally, if the Study button 25 is pressed, the wireless remote controller or alarm sensor is triggered to transmit a string of wireless electric signals having a specific identity code and operation code. A telescopic antenna 12 dedicated to wireless transceiving transfers the captured string of wireless electric signals to the wireless remote controller/alarm sensor signal receiving module board 22 through the antenna feeder 24 for amplification and shaping. Then, the embedded microprocessor main control module board 16 reads and records the string of identity codes, thereby studying (binding) a certain triggered wireless remote controller or alarm sensor in the device.

The operation process of the wireless remote controller and alarm in the present invention is as follows.

In the present invention, when a wireless remote controller or alarm sensor transmits a wireless electric remote control or alarm signal, the signal is captured, and is identified by the embedded microprocessor. The received string of code signal is compared with identity codes of a plurality of alarms studied and recorded in advance. If the same code exists, it is determined that the signal is an effective remote control or alarm inside the system. According to the instructions of the remote control or alarm code, the embedded microprocessor performs operations such as defense/withdrawal/siren sounding, or sends an alarm image and text to an email preset by a user on a local area network or the Internet through the wired and wireless broadband network module board 19, or sends an alarm picture and short message to a mobile phone of a user through the GPRS mobile phone short message and multimedia message transceiver module board 27.

The image monitoring process in the present invention is as follows.

The optical lens 13 focuses and projects the image in the monitoring area on the image sensor (a CMOS or a CCD apparatus). The image sensor module 31 converts an optical signal into an electric signal and inputs the electric signal in the embedded microprocessor control device. The embedded microprocessor control device analyzes the image inside the preset monitored alarm area under control of software. When pixels in adjacent two or more images change (images analyzed per second is 1 to 10 frames), it is determined that a moving object exists.

If a moving object appears in the alarm area in the monitored image, the embedded microprocessor control device video records, photographs, and records the moving object that enters the picture in a memory automatically under control of software, sends a video or photograph to a preset mailbox through an email or to a preset mobile phone through a multimedia message, and transmits an audio/light alarm signal at the same time.

The parts not described in the present invention such as circuit designs and structures are similar to the prior art or may be implemented by using the prior art. Especially, each electrical module assemblies may be implemented with corresponding circuits or existing integrated blocks and field programmable gate arrays (FPGAs) by referring to related instruction manuals or textbooks.

What is claimed is:

1. A device for integrated network intelligent security monitoring and alarming, comprising:

a front cover (6) and a rear cover (10);

a light-emitting diode (LED) infrared lighting circuit board (3) is installed on the front cover (6), an embedded microprocessor main control module board (16) and a wired and wireless broadband network module board (19), an image sensor module board (31), a wireless remote controller/alarm sensor signal receiving module board (22), a general packet radio service (GPRS) mobile phone short message and multimedia message transceiver module board (27), a siren control circuit board (21), and a piezoelectric speaker (20) electrically connected to the embedded microprocessor main control module board (16) are installed in an installing cavity between the front cover (6) and the rear cover (10);

the wired and wireless broadband network module board (19) is connected to a hidden 2.4 GHz or GPRS transceiver antenna (29) through a feeder (42);

an image sensor module board (31) is installed at an upper part of the wired and wireless broadband network module board (19), connection sockets (43, 44) electrically connected to the image sensor module board (31) is disposed on the embedded microprocessor main control module board (16);

a lens mount (30) of a fixed optical lens (13) is installed on the image sensor module board (31), the optical lens (13) is connected to a manual focus ring (1) through the embedded microprocessor main control module board (16);

the front cover (6) and the LED infrared lighting circuit board (3) and an infrared light shield (2) installed on the front cover (6), infrared light-emitting diodes (5) and a luminance sensor (4) are installed on the LED infrared lighting circuit board (3), the infrared light shield (2) is installed in front of the LED infrared lighting circuit board (3);

the piezoelectric speaker (20) is installed in the rear cover (10) and is connected to the siren control circuit board (21) through wires (33), the siren control circuit board (21) is connected to the wireless remote controller/alarm sensor signal receiving module board (22) through an antenna feeder (24);

the wireless remote controller/alarm sensor signal receiving module board (22) and the embedded microprocessor main control module board (16) are electrically through plugging, one end of a telescopic wireless transceiver antenna (12) is fixed on the siren control circuit board (21) and is electrically connected thereto, and the other end of the telescopic wireless transceiver antenna (12) extends out of the rear cover (10).

2. The device for integrated network intelligent security monitoring and alarming according to claim 1, wherein a miniature microphone (32), a memory card socket (15), an LED power indicator (40), and a status indicator (41) which are electrically connected to a main circuit of the embedded microprocessor main control module board (16) are installed on a front side of the embedded microprocessor main control module board (16), a semiconductor memory card (14) is plugged in the memory card socket (15), and a sound receiving hole (9) is disposed on the front cover (6) at a position corresponding to the miniature microphone (32).

3. The device for integrated network intelligent security monitoring and alarming according to claim 1, wherein a sound resonant cavity (23) is disposed at an inner side of the rear cover (10), the sound resonant cavity (23) is connected to outside through a sound hole (39) disposed on the rear cover (10), and the piezoelectric speaker (20) is embedded in the sound resonant cavity (23).

4. The device for integrated network intelligent security monitoring and alarming according to claim 1, wherein a subscriber identity module (SIM) card (28) is installed on the GPRS mobile phone short message and multimedia message transceiver module board (27), the GPRS mobile phone short message and multimedia message transceiver module board (27) and an input/output signal connection port (11) are electrically connected through plugging, and the input/output signal connection port (11) is installed on the embedded microprocessor main control module board (16) and connected to the main circuit thereof.

5. The device for integrated network intelligent security monitoring and alarming according to claim 1, wherein a DC power socket (17), a network connection socket (18), a Study button (25) for remote controller and alarm study, and a Reset button (26) for system reset are further connected to the wired and wireless broadband network module board (19), and corresponding through holes (34, 36, 37, 38) are disposed at corresponding positions on the rear cover (10).

6. The device for integrated network intelligent security monitoring and alarming according to claim 1, wherein a fixed connecting hole (35) is disposed at a lower part of the rear cover (10) or the front cover (6).

7. The device for integrated network intelligent security monitoring and alarming according to claim 1, wherein the LED infrared lighting circuit board (3) and the infrared light shield (2) are connected through plugging, and locking holes (8) for matching claws (7) on the infrared light shield (2) are disposed on the LED infrared lighting circuit board (3).

* * * * *